US006796156B2

(12) United States Patent
Natalis et al.

(10) Patent No.: US 6,796,156 B2
(45) Date of Patent: Sep. 28, 2004

(54) OBJECT-MARKING DEVICE

(75) Inventors: Giovanni Natalis, Cesano Maderno (IT); Paolo Stefanelli, Milan (IT)

(73) Assignee: Sitel, S.p.A. (IT)

( * ) Notice: Subject to any disclaimer, the term of this patent is extended or adjusted under 35 U.S.C. 154(b) by 28 days.

(21) Appl. No.: 10/123,844

(22) Filed: Apr. 16, 2002

(65) Prior Publication Data

US 2003/0097865 A1 May 29, 2003

(30) Foreign Application Priority Data

Nov. 23, 2001 (IT) ..... MI2001A2466
Mar. 8, 2002 (IT) ..... MI2002A0482

(51) Int. Cl.[7] ..... B21B 1/00; B21C 37/30
(52) U.S. Cl. ..... 72/75; 29/90.01
(58) Field of Search ..... 72/75; 29/90.01

(56) References Cited

U.S. PATENT DOCUMENTS 2,048,598 A * 7/1936 Christiansen ..... 72/75
3,735,615 A * 5/1973 Shneider ..... 72/75
4,008,593 A * 2/1977 Ciccarello ..... 72/75
4,947,668 A * 8/1990 Ostertag ..... 72/75
5,596,896 A * 1/1997 Snell ..... 72/75
6,622,570 B1 * 9/2003 Prevey, III ..... 73/826

* cited by examiner

*Primary Examiner*—Ed Tolan
(74) *Attorney, Agent, or Firm*—James B. Conte; Barnes & Thornburg LLP

(57) ABSTRACT

A support and holding structure (2) houses a fluid-operated actuator (17) controlling movement of a tool (7) close to and away from an object being marked ("A") and movement means causing shifting of same on the surface ("S") to be marked. The marking tool (7) comprises a ball or other engraving rolling element (7*a*) rotatably housed in a rolling seating (10) by interposition of small sliding balls (13). The rolling seating (10) has a rolling portion (10*a*) concentric with the engraving ball (7*a*), at which the efforts transmitted through the ball itself are discharged, and a recirculation portion (10*b*) spreading away from the rolling portion (10*a*) to ensure recirculation of the small sliding balls (13) during marking.

12 Claims, 6 Drawing Sheets

OBJECT-MARKING DEVICE

BACKGROUND OF THE INVENTION

1. Field of the Invention

The present invention relates to a device for carrying out marking of objects comprising: a support structure to be fastened to a bearing element; an engraving tool movable along a reference axis with respect to an object to be marked, between a contact position at which it intercepts said object to be marked and a disengagement position at which it is spaced apart from the same; movement means to move said engraving tool in a plane substantially normal to the reference axis.

The invention particularly applies to the sector involving surface marking of objects and/or articles of manufacture requiring one or more identification marks and/or surface-engraving operations of another type having technical and/or esthetical purposes for example.

2. Prior Art

It is known that said tooling operations are usually carried out by means of appropriate devices exploiting the properties of particular engraving tools that are capable of penetrating into the material forming the object to be marked so as to engrave it.

Generally, the engraving tools with which known marking devices are equipped are moved by a movement and positioning system within a preset working area, along Cartesian axes located in a support structure of the device itself.

The movement and positioning system is arranged to guide the engraving tool, upon direct command of a programmable electronic control unit, between a disengagement position, at which said tool is spaced apart from the surface of the object or workpiece being marked and an engagement position at which the engraving tool penetrates into said surface being marked.

The movement system is in addition adapted to move the engraving tool in a plane substantially parallel to the surface being marked so as to generate a surface furrow by means of the engraving tool disposed in the engagement position.

During execution of identification marks and/or surface signs of any other type, the engraving tools must be often moved away from the surface being marked to be then placed thereon again in a different position from that previously occupied. Movements of the engraving tool close to and away from the surface being marked exclusively depend on the design, pattern or inscription to be carried out which can also be particularly discontinuous.

A marking device similar to the one described above is disclosed in detail in document EP 0952008.

The foregoing being stated, the Applicant has found that, although known marking devices enable accomplishment of different identification marks and/or surface incisions of other type, they however have some drawbacks and are susceptible of improvements under different points-of view, mainly in connection with the quality of the engraving, efficiency and reliability of the device during execution of said engraving and duration of life and preservation of the engraving tools that presently appear to be brittle and expensive.

In fact, during the surface-engraving operations, the engraving tool can be subjected to jamming due to the resistance of the material being marked. Obviously, this phenomenon may cause damage to the workpiece, the engraving tool used and/or also the marking device itself, which will involve exceptional maintenance interventions and, as a result, additional production costs.

Tool-damaging and/or breaking phenomena can also easily occur due to interference of the engraving tool with the object being marked, should the tool for example be shifted from a point of the marking surface to another before its reaching the disengagement position.

Damage of the engraving tool may also depend on a quick displacement of same from the disengagement position to the engagement position. In fact, a sharp penetration into the surface to be marked may cause breaking of the tools, above all where particularly brittle and expensive tools such as diamond tools are concerned.

SUMMARY OF THE INVENTION

It is an aim of the present invention to solve the problems found in the known art and, in particular, to ensure duration of life of the engraving tool used.

It is a further aim of the invention to propose a marking device adapted to carry out surface incisions of excellent quality and reliability.

The foregoing and further aims that will become more apparent in the course of the following description, are substantially achieved by a marking device comprising at least one engraving rolling element rotatably engaged in a rolling seating-arranged in a housing body, in accordance with the features set out in the characterizing portion of claim 1 and/or in one or more of the subsequent claims.

In accordance with a further aspect, it is an aim of the invention to provide an engraving tool to be used on marking devices and comprising at least one engraving rolling element rotatably engaged in a rolling seating arranged in a housing body.

BRIEF DESCRIPTION OF THE DRAWINGS

Further features and advantages will become more apparent from the detailed description of a preferred but not exclusive embodiment of a device for carrying out marking of objects in accordance with the present invention. This description will be set out hereinafter with reference to the accompanying drawings given by way of non-limiting example, in which.

DESCRIPTION OF THE PREFERRED EMBODIMENT

Figure 1:
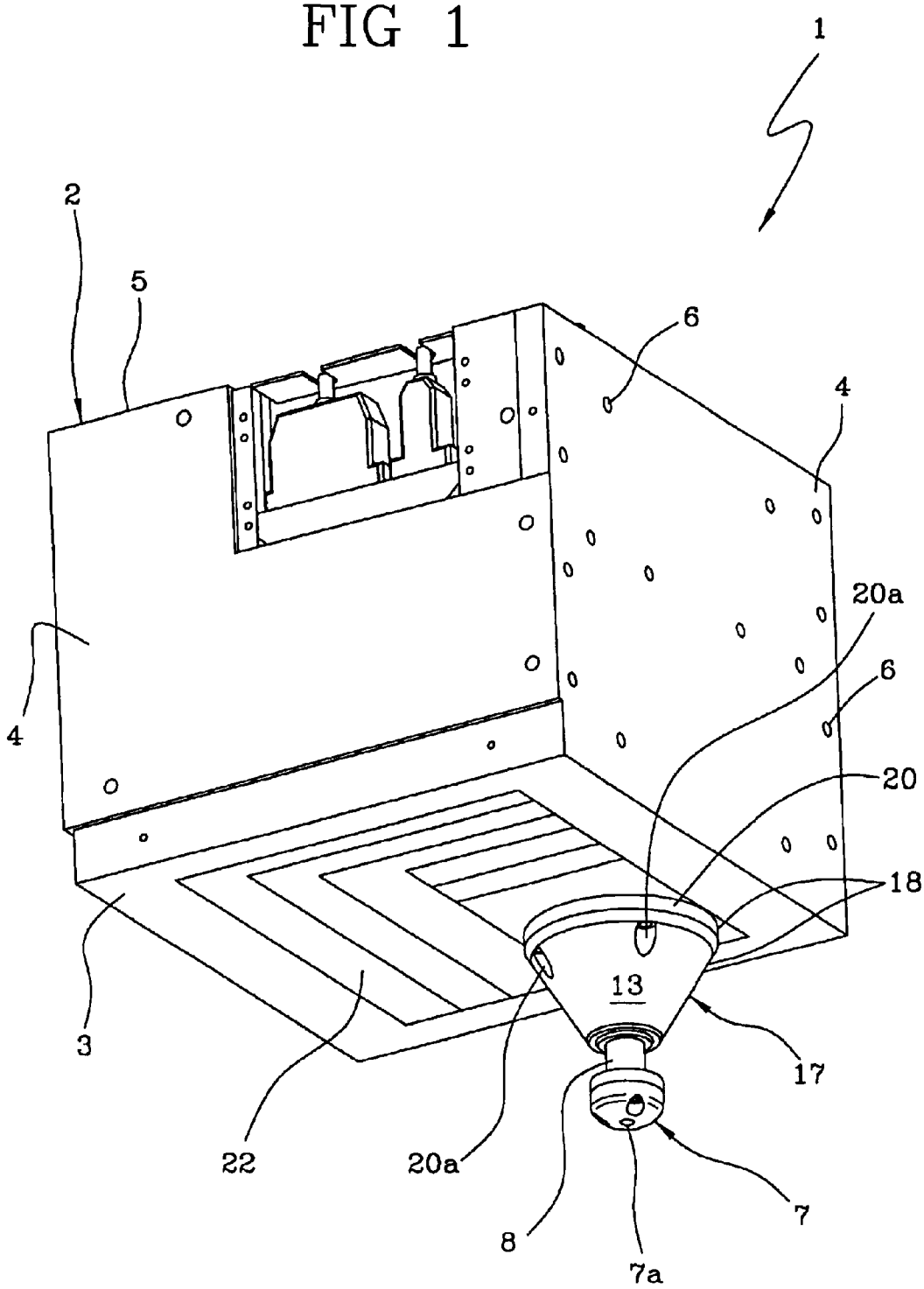
FIG. 1 is a perspective view of a device for carrying out marking of objects in accordance with the present invention.

With reference to the drawings, a device for carrying out marking of objects in accordance with the present invention has been generally identified by reference numeral 1.

As shown in FIG. 1, the marking device 1 comprises a support structure 2 of substantially box-shaped conformation to be fastened to an appropriate bearing element (not shown). In detail, the support structure 2 involves a main base wall 3 from which four side walls 4 extend which, on the opposite side from the main base wall 3, terminate against a closing wall 5. One or more of walls 3, 4, 5 of the support structure 2 may be provided with a series of fastening holes 6 each arranged to engage a respective threaded element (not shown as known by itself) to steadily fasten the support structure 2 to the above mentioned bearing element.

As shown in FIGS. 1 to 5, device 1 is provided with en engraving tool 7 operatively in engagement with the support structure 2 and active at the inside of a preset working space in which an object being worked or workpiece "A" is held and/or conveniently moved during the marking process.

The engraving tool 7 is preferably movable along a reference axis "Z" substantially normal to a surface being marked "S" of the workpiece "A", between a contact position at which it intercepts said workpiece and a disengagement position at which it is spaced apart therefrom.

Figure 3:
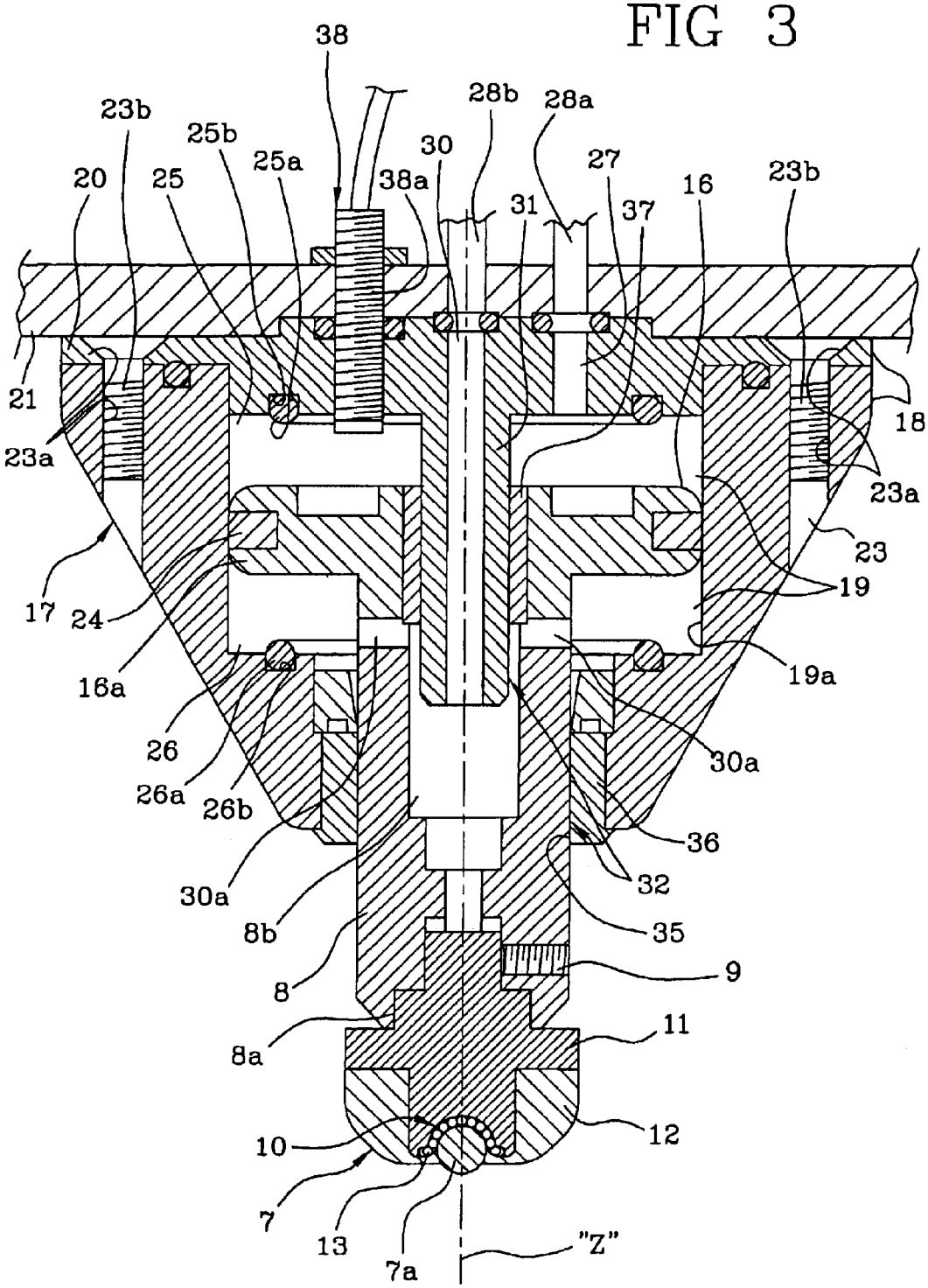
FIG. 3 is a sectional elevation view of the above component taken along line III—III in FIG. 2.

As shown in FIG. 3, the engraving tool 7 is removably engaged in a housing seating 8*a* formed in the structure of a movable member 8 to be described in detail below. More specifically, the engraving tool 7 can be mounted and dismantled on and from the movable member 8 by screwing through appropriate attachment means 9 to be positioned at the housing seating 8*a*.

Figure 4:
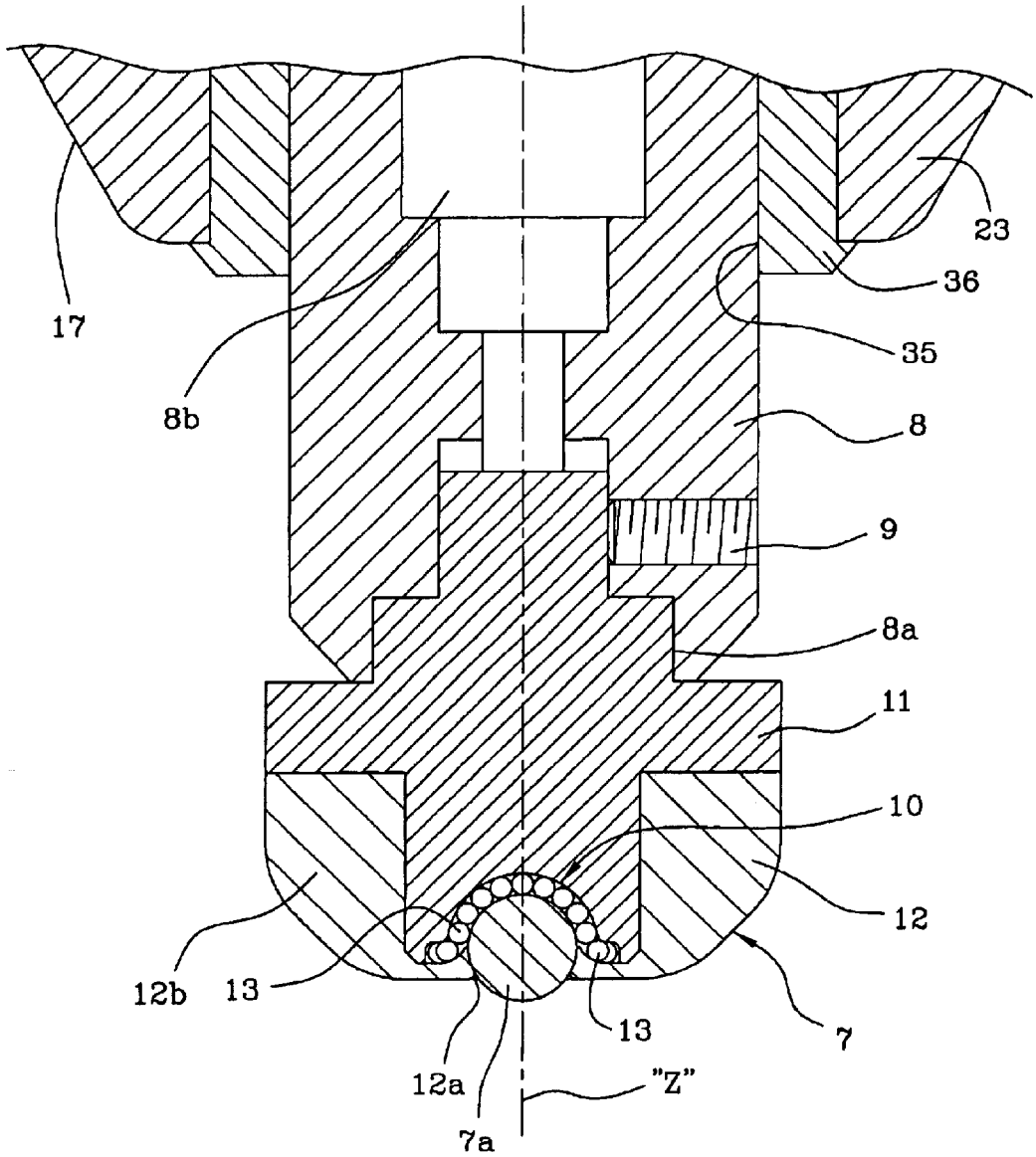
FIG. 4 is an enlarged sectional view of a detail of the component shown in FIG. 3.
Figure 5:
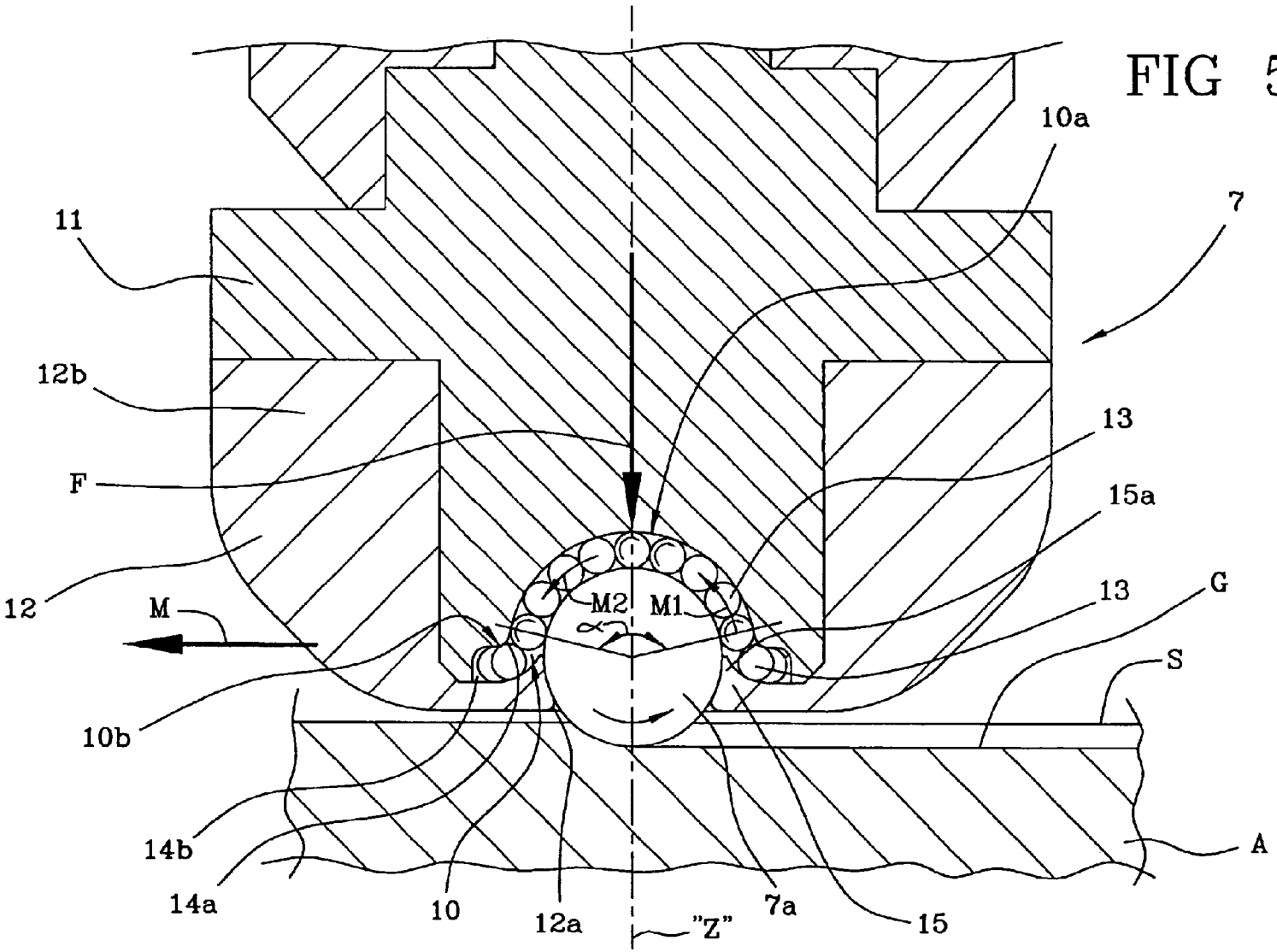
FIG. 5 shows a detail seen in FIG. 4 on a more enlarged scale.

In accordance with the present invention, the engraving tool 7 comprises at least one engraving rolling element 7*a* made of steel for example. As shown in FIGS. 3, 4 and 5, the engraving rolling element 7*a* is made up of a ball of a diameter, just as an indication, included between 1 and 10 mm and preferably included between 2.5 and 7 mm, rotatably engaged in a respective rolling seating 10 carried by said movable member 8. In more detail, the rolling seating 10 can be at least partly formed in the movable member 8 or, as provided in the example shown, in a housing body 11 to be fastened to the housing seating or cavity 8*a* of the movable member 8 by said attachment means 9. Also associated with the housing body 11, preferably through threaded fastening elements 12*b*, is a closure cap 12 defining the lower portion of the rolling seating 10 of the engraving ball 7*a*. At the rolling seating 10, and more specifically through the closing cap 12, a work opening 12*a* is formed the diameter of which is lower than the diameter of the engraving ball 7*a* which at the lower part thereof is free to project from the work opening itself to operate on the surface being marked "S" of the workpiece "A" without disengaging from the rolling seating 10.

Also preferably provided is the presence of friction-reducing means which is operatively interposed between the rolling seating 10 and engraving ball 7*a*. In the embodiment shown in FIGS. 3, 4 and 5, the friction reducing means consists of a plurality of rolling elements 13 set to roll against the rolling seating 10 and the outer surface of the engraving ball 7*a* when the latter is led to rotate during marking. More particularly, the rolling elements 13 preferably consist of small sliding balls of a lower diameter than that of the engraving ball 7*a*. In this connection it should be noted that the ratio between the diameters of the engraving ball 7*a* and small sliding balls 13 is preferably provided to be as high as 5:1 or higher, and at all events not less than 3:1. Lower ratio values than the stated ones would involve too great a size increase of the small sliding balls 13 and tool 7 as a whole, as well as a reduced structural strength and fluidity of movement, due to the reduced number of small balls 13 used.

During marking, the engraving ball 7*a* is pushed against the surface being engraved "S" with a force "F" directed along the reference axis "Z", and simultaneously moved to generate a furrow "G" on the surface itself which extends along the desired path.

To promote a smooth rolling without jamming, even in the presence of thrust forces "F" in the order of hundreds of kilos, the rolling seating 10 is preferably provided, as better shown in FIG. 5, to have a hemispheric rolling portion 10*a*, the bend diameter of which preferably corresponds to the sum of the diameters of the engraving ball 7*a* and the small sliding balls 13, and a recirculation portion 10*b* spreading away from the rolling portion 10*a* and extending around the engraving ball itself. In more detail, two regions are preferably provided to be identified in the recirculation portion 10*b*, i.e. a connecting region 14*a* spreading away from the rolling portion 10*a* so as to form an arched profile, and an end region 14*b* extending radially away from the reference axis "Z" and circumscribing the engraving ball 7*a* in a plane perpendicular to the reference axis itself.

The overall extension of the recirculation portion 10*b* in a diametrical sectional plane preferably does not exceed twice the diameter of each small sliding ball 13. In this way, in any diametrical half-section of the rolling seating 10, no more than two small sliding balls 13 appear to be disengaged from the rolling portion 10*a*.

To promote correct conveying of the small sliding balls 13 towards the end region 14*b*, the closing cap 12 is preferably provided, along the opening work edge 12*a*, with a perimetric ridge 15 facing the rolling seating 10, to define a lead-in surface 15*a* substantially parallel to the connecting region 14*a* of the recirculation portion 10*b*.

The amount of the small sliding balls 13 substantially corresponds-to-the maximum number allowed by the space present in the rolling seating 10, preferably reduced by one or more units, five units at most, to promote smooth flow of the system.

During marking, the small sliding balls 13 disposed in the rolling portion 10*a* are concerned with rolling of the engraving ball 7*a*. More particularly, supposing to move the tool shown in FIG. 5 for example to the left in the plane of the drawing as shown by arrow "M", the engraving ball 7*a* will roll in a counterclockwise direction on the surface to be marked "S". Consequently, the small balls 13 placed to the right of the reference axis "Z" will move around the rotation center of ball 7*a* away from the recirculation portion 10*b* towards the reference axis itself, as denoted by arrow "M1", whereas the small balls 13 placed to the left of the reference axis "Z" will move towards the recirculation portion 10*b*, as denoted by arrow "M2".

The small balls 13 acceding to the recirculation portion 10*b* loose their contact with the engraving ball 7*a*, and are ready to travel over the recirculation portion itself carrying out their movement in the end region 14*b* around ball 7*a*, in a plane perpendicular to the reference axis "Z", until they reach the opposite side of ball 7*a* to go then up towards the reference axis "Z" along the direction denoted by arrow "M1". The recirculation portion 10*b* therefore enables the individual small sliding balls 13 to disengage from the engraving ball 7*a*, so that they are able to move around said engraving ball in a direction opposite to the movement imposed to them by rolling of the ball itself close to the rolling portion 10*a*.

The Applicant has found that the small sliding balls 13 placed at the top of the rolling portion 10*a* support a major part of the vertical thrust "F" transmitted to ball 7*a* to ensure a sufficient penetration into the surface "S" to be marked, whereas the small balls 13 placed at the sides of ball 7*a* support the side thrusts resulting from movement of tool 7 along the direction "M". To efficiently resist all these loads without generating too many rubbing actions between ball 7*a* and the edge of the work opening 12, the rolling portion 10*a* is preferably provided to subtend an angle "α" at least as wide as 90° and preferably included between 120° and 150° around its center of bending. Values smaller than 90° could be insufficient to efficiently resist the side thrusts generated during marking, whereas with higher values the amount by which ball 7*a* projects downwardly from opening 12*a* would be undesirably reduced.

With reference to FIGS. 1, 3 and 4, the movable member 8 of device 1 is operatively interposed between the support structure 2 and the engraving tool 7 to shift the engraving tool itself between the disengagement position and the contact position. The movable member 8 has a substantially cylindrical structure and is rigidly in engagement with a piston 16 of a fluid-operated actuator 17, preferably of the pneumatic type, interposed between the support structure 2 and the engraving tool 7.

In more detail, the fluid-operated actuator 17 comprises at least one holding body 18 inside which at least one cylindrical hollow space 19 is defined which is in communication with feeding means 1*a* (FIG. 6) to supply compressed air or other fluid under pressure.

Figure 2:
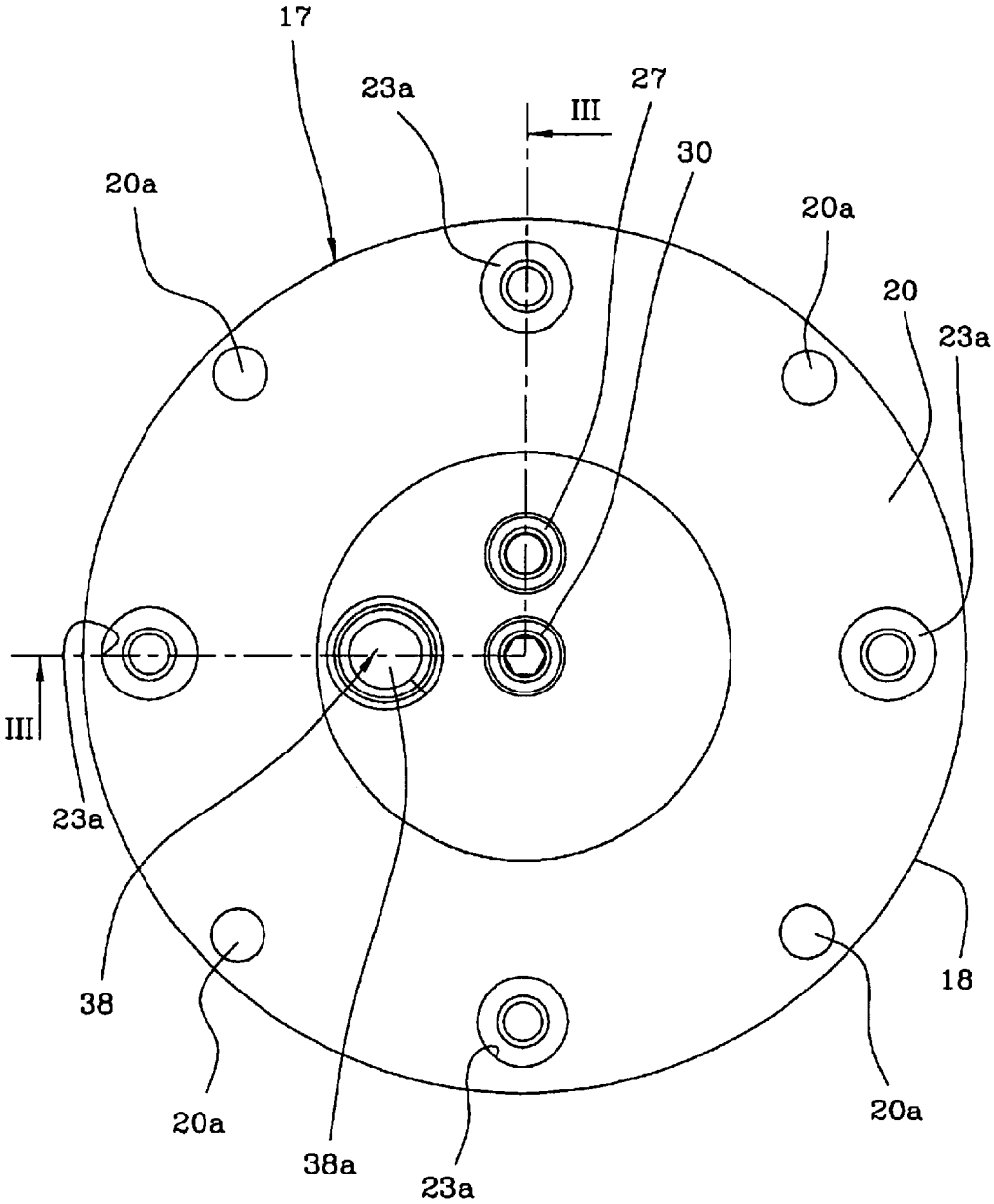
FIG. 2 is a top view of a component of the device shown in FIG. 1.

As viewed from FIGS. 1, 2 and 3, the holding body 18 of the fluid-operated actuator 17 is adapted to be fastened, by means of at least one attachment portion 20, directly to an attachment plate 21 of proper movement means (not shown) disposed within the support structure 2 and designed to move the engraving tool 7 in a plane substantially perpendicular to the reference axis "Z". In detail, the attachment portion 20 can be fastened to the attachment plate 21 by first threaded fastening elements (not shown) to be engaged in respective first fastening through openings 20*a* formed in the attachment portion itself. With reference to FIG. 1, the movement means can be covered with a telescopic protection structure 22 associated with the attachment plate 21 and operatively located in the base surface 3 of the support structure 2.

The holding body 18 of the fluid-operated actuator 17 further comprises a support portion 23 to be fastened to the attachment portion 21 by additional threaded fastening elements 23*b* arranged to engage respective second fastening openings 23*a* partly formed through the support portion 23 and partly through the attachment portion 20.

As viewed from FIGS. 3 and 4, the cylindrical hollow space 19 houses the above mentioned piston 16 which is free to slide therein, being rigidly secured to the movable member 8. More particularly, piston 16 has a substantially disk-shaped structure having a perimetric edge 16*a* slidably and sealingly engaging a side wall 19*a* of the cylindrical hollow space 19 by means of a first seal 24 and defining variable-volume first and second chambers 25, 26 in said hollow space. The first chamber 25 is localized at the attachment portion 20 of the fluid-operated actuator 17, whereas the second chamber 26 is disposed opposed to the first chamber 25 with respect to piston 16.

As shown in FIGS. 3 to 6 the first chamber 25 is in communication with said fluid-feeding means 1*a*, by a first passage duct 27 formed through the holding body 18 of the fluid-operated actuator 17. In more detail, the first passage duct 27 extends from the first chamber 25 through the attachment portion 20 of the holding body 18 to be hermetically connected to a first feed duct 28*a* of a fluid-operated circuit 28 disposed within the support structure 2.

Figure 6:
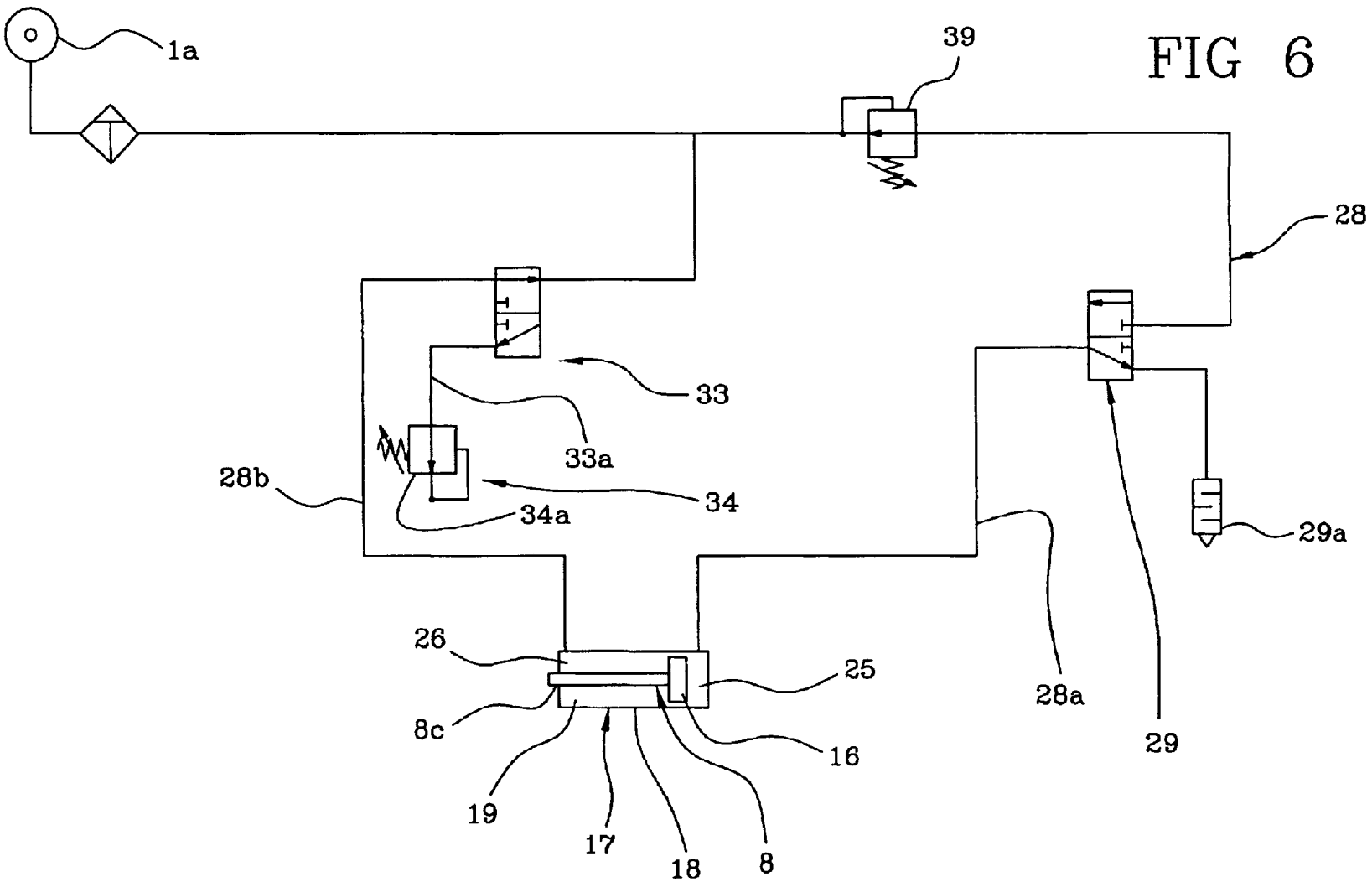
FIG. 6 is a diagrammatic representation of a fluid-operated circuit of the device shown in FIG. 1.

As shown in FIG. 6, operatively in engagement with the first feed duct 28*a* is a valve assembly 29 switchable between a charging condition in which it connects the feeding means 1*a* to the first passage duct 27 and, consequently the first chamber 25, and a discharge condition in which the first passage duct 27 as well as the first chamber 25 are connected to a first discharge union 29*a* directly opening into the surrounding atmosphere.

On the contrary, the second chamber 26 is in fluid communication with the feeding means 1*a* through a second passage duct 30 formed at least partly through the holding body 18 of the fluid-operated actuator 17. More specifically, as shown in FIG. 3, the second passage duct 30 longitudinally passes through a guide element 31 being part of guide means 32 of the device 1 to be described in detail later on. The second passage duct 30 opens into the cavity 8*b* of the movable member 8 which is in communication with the second cylindrical chamber 26 through outflow side ports 30*a* defined in the movable member 8. The second passage duct 30 is hermetically connected to a second feed duct 28*b* of the fluid-operated circuit 28 with which a second valve assembly 33 (FIG. 6) is operatively in engagement, said valve assembly being switchable between a charging condition in which it connects the feeding means 1*a* with the second passage duct 30 and consequently the second cylindrical chamber 26, and a discharge condition in which the second passage duct 30 and second cylindrical chamber 26 are connected to a second union 33*a* for discharge to the surrounding atmosphere.

Device 1 further comprises at least one adjusting member 34 operatively associated with the movable member 8 to establish the displacement speed of the engraving tool 7 from the disengagement position to the contact position. The adjusting member 34 comprises at least one flow-adjusting valve 34*a* or other similar throttling element operatively associated with the second passage duct 30 and more specifically with the discharge union 33*a* of the fluid-operated circuit 28, as shown in FIG. 6.

To conduct the engraving tool 7 between the contact position and disengagement position, piston 16 is axially reciprocated within the cylindrical hollow space 19 upon command of the valve assemblies 29, 33 alternately sending air under pressure to the first and second cylindrical chambers 25, 26. Both the first and second cylindrical chambers 25, 26 are each provided with a respective limit shock-absorbing element 25*a*, 26*a* arranged to avoid undesired shocks between the piston 16 and holding body 18 of the fluid-operated actuator 17. In detail, each shock-absorbing element 25*a*, 26*a* has a substantially annular conformation and is engaged in a respective circular groove 25*b*, 26*b* formed in the respective cylindrical chamber 25, 26 on opposite side with respect to piston 16.

As shown in FIG. 3, said guide means 32 is preferably formed in the holding body 18 of the fluid-operated actuator 17 to slidably engage the movable member 8 so that the engraving tool 7 may be conducted along the reference axis "Z" and maintained correctly in alignment with respect to said axis.

In detail, the guide means 32 further comprises at least one guide seating 35 axially spaced apart from the guide element 31. Preferably, the guide seating 35 is formed through the support portion 23 at the second chamber 26, and the guide element 31 is formed of one piece construction with the attachment portion 20 through the first chamber 25, being coaxial with the guide seating 35. As shown in FIGS. 3 and 4, the guide seating 35 is slidably engaged by the movable member 8, through a first centering bush 36, whereas the guide element 31 slidably engages the cylindrical cavity 8*b* extending in the movable member itself, by a second centering bush 37. The guide element 31 extends a sufficient amount to ensure its insertion into the cylindrical cavity 8*b* even when the engraving tool 7 is disposed in the contact position, so as to guarantee a precise and constant guide action during the whole stroke of piston 16.

Device 1 may further comprise sensor means 38 active on the movable member 8 to detect the position of the engraving tool 7 and communicate it to a programmable electronic control unit (not shown) adapted to control movement of the movable components of the device itself. In detail, the sensor means 38 is arranged to detect the position of the engraving tool 7 by detecting the position of piston 16.

In the embodiment shown in FIGS. 2 and 3, the sensor means 38 preferably consists of at least one proximity sensor 38*a* operatively in engagement with the holding body 18 of the fluid-operated actuator 17 through the attachment portion 20 thereof. The proximity sensor 38*a* is set to detect the position of piston 16 when the engraving tool 7 is placed in its disengagement position. In this position piston 16 is disposed close to the attachment portion 20 and close to sensor 38*a* which is activated and communicates the position of piston 16 and consequently that of the engraving tool 17 to the programmable electronic control unit.

Operation of the concerned device described above mainly as regards structure is as follows.

During a surface engraving operation, the programmable electronic control unit starts the movement means up to bring the movable member 8, and consequently the engraving tool 7, to the starting point of the marking to be executed. Subsequently, the programmable electronic control unit switches the first valve assembly 29 to the first condition and connects the first chamber 25 with the feeding means 1*a* through the first feed duct 28*a* of the fluid-operated circuit 28 and the first passage duct 27 of the fluid-operated actuator 17. Simultaneously, the second valve assembly 33 is switched to the second condition to connect the second chamber 26 with the second union 33*a* for discharge to the atmosphere, through the second feed duct 28*b* of the fluid-operated circuit 28 and second passage duct 30 of the fluid-operated actuator 17.

Under this situation, the fluid under pressure from the feeding means 1*a* reaches the first chamber 25 pushing piston 16 towards the second chamber 26. Due to the difference of pressure between chambers 25, 26, piston 16 axially slides within the cylindrical hollow space 19 being guided by the guide seating 35 and the guide element 31. The engraving tool 7 is thus conducted from the disengagement position to the contact position in which it penetrates into the surface of the object being marked with a preset force established by the pressure of the air fed to the first chamber 25. In this connection, a pressure adjusting valve 39 may be set along the fluid-operated circuit 28 in order to adjust the thrust exerted by the engraving tool 7 in the contact position.

Advantageously, the presence of the adjusting member 34 in the second union 33*a* enables displacement of piston 16 and engraving tool 7 from the disengagement position to the contact position to be controlled and operated by intervening on the fluid discharged to the atmosphere. In other words, by the adjusting member 34 the speed of the engraving tool 7 on moving close to the workpiece can be controlled. This enables strong impacts of the engraving tool 7 against the surface being marked "S" to be avoided, which impacts could cause breaking and/or damaging of said tool.

Once surface "S" of workpiece "A" has been penetrated, the programmable electronic control unit operates the movement means again to move the engraving tool 7 along the stored trajectory, thereby engraving the workpiece. During marking, due to the resistance of the workpiece material, forces opposed to the movement direction of the engraving tool 7 are generated which tend to bend piston 16.

Due to use of the engraving tool 7 proposed by the present invention, these forces are greatly mitigated as compared with those generated with use of tools with a diamond tip or similar tools of the known art.

In addition, tool 7 is correctly maintained in straight alignment by the guide means 32. In more detail, the guide seating 35 and guide element 31 of the guide means 32 mutually cooperate to counteract the forces resisting to marking, thereby avoiding any possible jamming of the engraving tool 7.

When the length to be engraved is finished, tool 7 is required to be moved away from the workpiece for carrying out another marking in the workpiece itself or a marking in a new workpiece. Moving away of the engraving tool 7 from the workpiece "A" being marked is carried out by simultaneously switching the first and second valve assemblies 29, 33, respectively from the first to the second conditions to connect the first chamber 25 to the atmosphere and from the second to the first condition to connect the second chamber 26 to the feeding means 1*a*. In this manner, the fluid under pressure admitted to the second chamber 26 acts on piston 16 pushing it towards the first chamber 25. Since said chamber is in direct connection with the atmosphere, piston 16 is free to slide towards the first chamber 25 without any resistance, so that the engraving tool 7 is immediately conducted from the contact position to the disengagement position.

When the engraving tool 7 reaches the disengagement position, the proximity sensor 38*a* detects the presence of piston 16 and communicates this presence to the programmable electronic control unit which is consequently again enabled for activation of the positioning means to move the engraving tool from the last position taken to a new position corresponding to the starting point of the new marking to be carried out. The engraving tool 7 is again shifted from the disengagement position to the contact position to carry out a new marking length as above described.

The present invention solves the problems found in the known art and achieves the intended purposes.

First of all, by the described marking device 1 it is possible to obtain surface incisions of excellent quality finishing of which is not at all impaired. In fact, with the proposed marking device 1 there is no jamming of the engraving tool 7 and/or bending of the movable member 8 (as it happened in the known art). Therefore, the object being marked as well as the engraving tool 7 and the device itself are not at all damaged even during execution of deep incisions in very hard materials. In addition, accomplishment of surface markings is no longer interrupted due to repair operations to be carried out on the device and/or replacement of the engraving tool 7.

It is also to be considered that the method of detecting the piston position concurrently with a direct connection of the first chamber 25 with the atmosphere, protects the engraving tool 7 from undesired shocks against the workpiece and ensures the structural integrity of the latter as well as that of tool 7. In fact, the direct connection of the first chamber 25 to the atmosphere enables the fluid under pressure admitted to the second chamber 26 to quickly move the engraving tool 7 away from the object being marked, whereas the proximity sensor 38*a* enables the disengagement position of the engraving tool 7 to be detected thereby enabling the programmable electronic control unit to activation of the positioning means in a quite safe manner.

In addition, use of a ball or other rolling element as the engraving tool allows surface markings of excellent quality to be obtained to a greatly lower cost than that obtainable with use of engraving tools 7 with a diamond tip. It is also to be considered that the engraving rolling element enables frictions generated between this element and the workpiece during the marking operations to be greatly reduced, due to the fact that this engraving tool can roll on itself. In addition, not only the engraving rolling elements 7 made of steel are less expensive than those with a diamond tip, but they are also less brittle and consequently cannot be easily broken and/or damaged.

What is claimed is:

1. A device for carrying out marking of objects comprising:

a support structure to be fastened to a bearing element;

an engraving tool movable along a reference axis with respect to an object to be marked, between a contact position at which it intercepts said object to be marked and a disengagement position at which it is spaced apart form said object; movement means to move said engraving tool in a plane substantially normal to the reference axis, wherein said engraving tool comprises at least one engraving rolling element rotatably engaged in a rolling seating arranged in a housing body wherein said engraving rolling element comprises an engraving ball, said engraving tool further comprising friction-reducing means operatively interposed between the engraving rolling element and said housing body, wherein said friction-reducing means comprises small sliding balls operatively interposed between the rolling seating and the engraving rolling element, and wherein said rolling seating has a hemispheric rolling portion and a recirculation portion spreading away from the rolling portion.

2. The device as claimed in claim 1, wherein said housing body has a work opening through which said engraving rolling element projects.

3. The device as claimed in claim 2, wherein said work opening is formed in a closing cap associated with said housing body.

4. The device as claimed in claim 1, wherein the recirculation portion comprises a union region spreading away from the rolling portion following an arched profile, and an end region extending in a plane perpendicular to the reference axis around said rolling element.

5. The device as claimed in claim 4, wherein said housing body has a work opening through which said engraving rolling element projects, further comprising a perimetric ridge defined along an edge of said work opening and defining a lead-in surface substantially parallel to the union region of the recirculation portion.

6. The device as claimed in claim 1, wherein the rolling portion subtends an angle wider than 90°, preferably included between 120° and 150°, around a center of bending of same.

7. The device as claimed in claim 1, wherein the rolling portion has a bend diameter corresponding to the sum of the diameter of the engraving ball and the small sliding balls.

8. The device as claimed in claim 1, wherein the ratio between the diameters of the engraving ball and the small sliding balls is at least as high as 3:1 and preferably higher than 5:1.

9. An engraving tool for marking devices comprising at least one engraving rolling element rotatably engaged in a rolling seating set in a housing body, wherein said engraving rolling element comprises an engraving ball projecting from a work opening arranged in the housing body, and small sliding balls operatively interposed between the rolling seating and the engraving rolling element, and wherein said rolling seating has a hemispheric rolling portion and a recirculation portion spreading away from the rolling portion.

10. The engraving tool as claimed in claim 9, wherein the recirculation portion comprises a union region spreading away from the rolling portion following an arched profile and an end region extending in a plane perpendicular to the reference axis around said rolling element.

11. The engraving tool as claimed in claim 10, further comprising a perimetric ridge defined along an edge of said work opening and defining a lead-in surface substantially parallel to the union region of the recirculation portion.

12. The engraving tool as claimed in claim 9, wherein the rolling portion subtends an angle wider than 90°, preferably included between 120° and 150°, around a center of bending of same.

* * * * *